US007226295B1

(12) United States Patent
Ju

(10) Patent No.: US 7,226,295 B1
(45) Date of Patent: Jun. 5, 2007

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 11/477,495

(22) Filed: Jun. 30, 2006

(51) Int. Cl.
*H01R 12/00* (2006.01)

(52) U.S. Cl. ..... 439/66

(58) Field of Classification Search ..... 439/66, 439/91, 591, 931, 531
See application file for complete search history.

(56) References Cited

U.S. PATENT DOCUMENTS 5,049,084 A * 9/1991 Bakke ..... 439/66
5,069,629 A * 12/1991 Johnson ..... 439/71
6,247,938 B1 * 6/2001 Rathburn ..... 439/66

* cited by examiner

*Primary Examiner*—Phuong Dinh
(74) *Attorney, Agent, or Firm*—Rosenberg, Klein & Lee

(57) ABSTRACT

An electrical connector includes an insulating body having a receiving space, a butting electronic element, and a swinging body. The swinging body is located in the receiving space and swingingly contacts the butting electronic element. The swinging body has a conducting material. The structure of the electrical connector is simple and easily manufactured. This invention makes the electrical connector contact the electronic element well and reduces the cost of manufacture.

20 Claims, 3 Drawing Sheets

ELECTRICAL CONNECTOR

BACKGROUND OF THE INVENTION

1. Field of the Invention

The present invention relates to an electrical connector. In particular, this invention relates to an electrical connector that ensures a firm contact with an electronic element and reduces manufacturing costs.

2. Description of the Related Art

Electrical connectors of the prior art usually include an insulating body, and conducting pins received in the insulating body. The insulating body is comprised of pin receiving slots and the conducting pins are received in the pin receiving slots. The conducting pin includes a fixing part and a contacting part located at the two ends of the conducting pin. The electronic element is pressed to electrically contact the conducting pins of the electrical connector. However, the shape of the conducting pin is complex. It is difficult to manufacture and expensive. Because the force is large when the electrical connector is connected with the electronic element, it is easily deformed after the conducting pins are pressed several times. Furthermore, because the electrical connector does not have a positioning structure, the connection between the electrical connector and the electronic element is unstable. Therefore, the electrical connector does not contact the electronic element well so that the function of the electrical connector is affected.

SUMMARY OF THE INVENTION

One particular aspect of the present invention is to provide an electrical connector. This invention ensures the electrical connector contacts the electronic element well and reduces the cost of manufacture.

The electrical connector includes an insulating body having a receiving space, a butting electronic element, and a swinging body. The swinging body is located in the receiving space and swingingly contacts the butting electronic element. The swinging body has a conducting material.

One further particular aspect of the present invention is to provide an electrical connector. This invention makes the electrical connector contact the electronic element well.

The electrical connector includes an insulating body having a receiving space, a butting electronic element, and a positioning structure. The positioning structure is located at the insulating body for positioning the butting electronic element and the insulating body.

The structure of the electrical connector is simple and it is easily manufactured. This invention makes the electrical connector contact the electronic element well and reduces the cost of manufacture.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1:
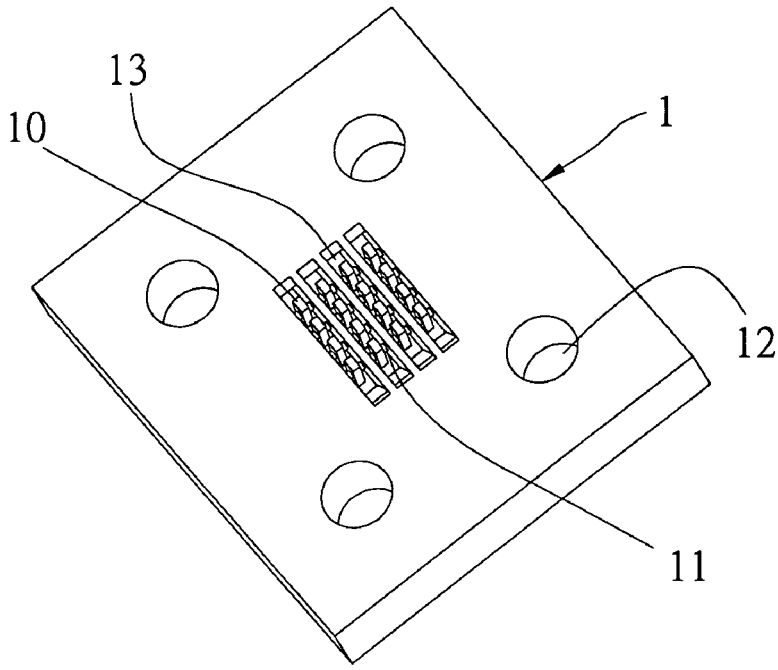
FIG. 1 is a perspective view of the electrical connector of the present invention.
Figure 2:
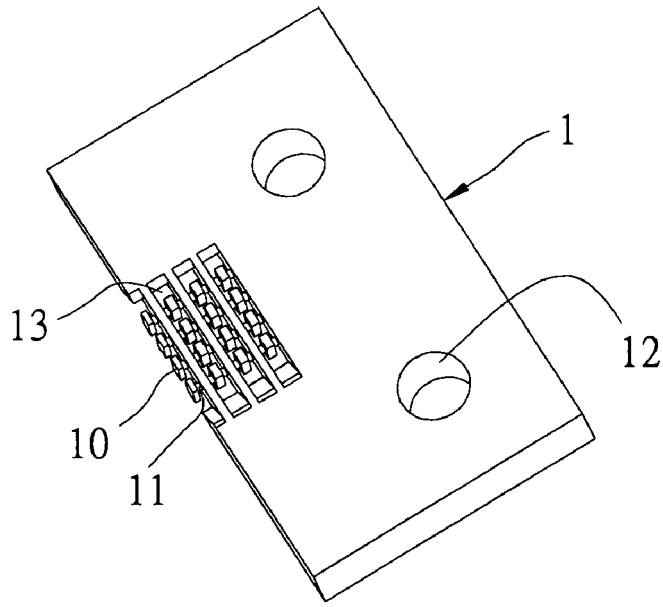
FIG. 2 is a cross-sectional view of the electrical connector of the present invention in FIG. 1.
Figure 3:
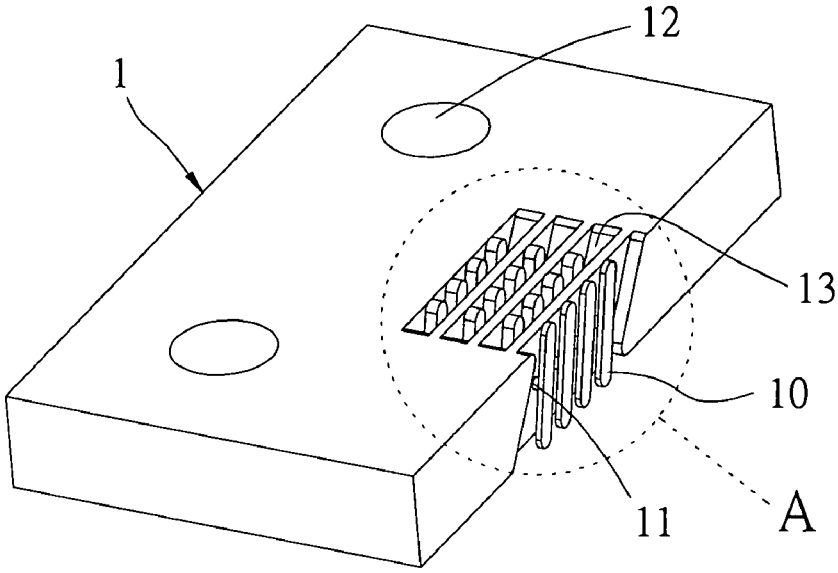
FIG. 3 is another cross-sectional view of the electrical connector of the present invention in FIG. 1.
Figure 4:
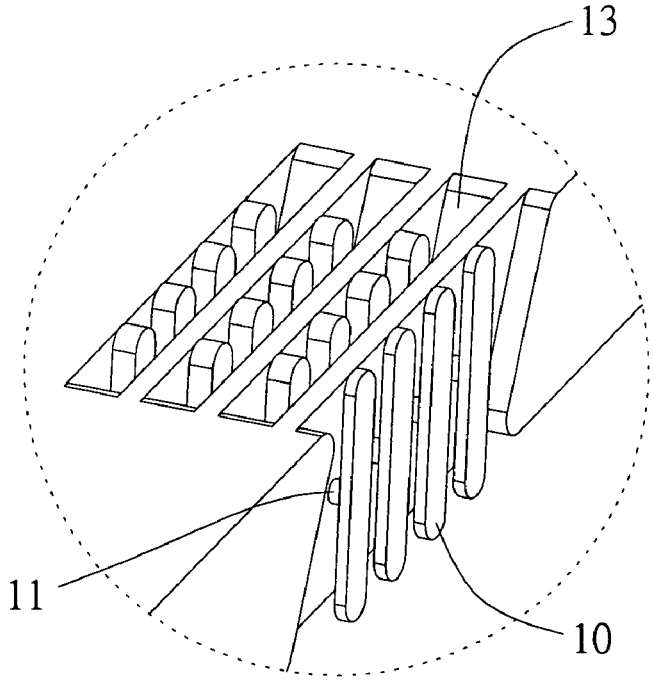
FIG. 4 is an amplified view of part of the electrical connector of the present invention in FIG. 3.
Figure 5:
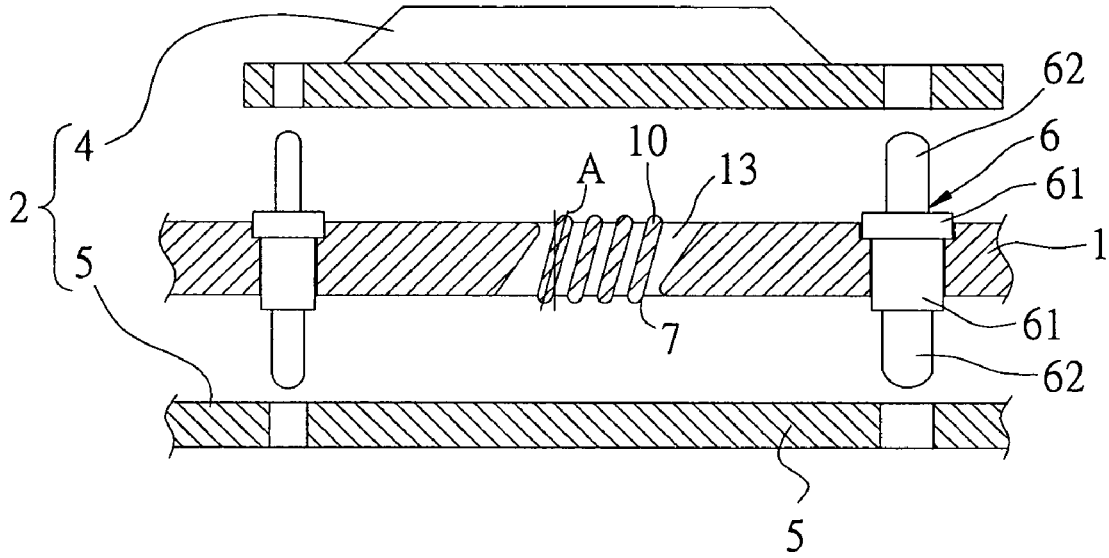
FIG. 5 is a cross-sectional view of the electrical connector of the present invention.

Reference is made to FIGS. 1~5, which show schematic diagrams of the electronic connector of the present invention. The electrical connector includes an insulating body 1 having a receiving space 13, a butting electronic element 2, and a swinging body 10. The swinging body 10 is located in the receiving space 13 and swingingly contacts the butting electronic element 2. In this embodiment, a chip module 4 contacts a butting electrical board 5. The swinging body 10 has a conducting material. The conducting material is a conducting layer 7. The conducting layer 7 is formed on the swinging body 10 via a physical film plating method (such as sputter plating, or evaporation plating). The insulating body 1 further includes a connecting part 11. The swinging body 10 is connected with the insulating body via the connecting part 11. There are contacting points located at two sides of the swinging body 10. The line A linked between the two contacting points is inclined to the surface of the insulating body 1. Thereby, the swinging body 10 is compressed to make the swinging body 10 rotate and swing for connecting with the butting electronic element 2. The swinging body 10 flexibly compresses and contacts the butting electronic element 2 via the connecting part 11. The swinging body 10 can recover to the original location by utilizing the recovery force produced by twisting of the connecting part 11. The insulating body 1 and the swinging body 10 are manufactured into one single piece, and the insulating body 1 and the swinging body 10 are made of flexible material.

The electrical connector further comprises at least two positioning structures 6 that fit in with the butting electronic element 2. Positioning holes are individually located at the four corners of the insulating body 1. The positioning structures 6 are fastened to the insulating body 1 via the positioning holes 12 for positioning the butting electronic element 2 and the insulating body 1. The positioning structure 6 includes a position-limiting part 61 that limits the compression height of the butting electronic element 2. Alternatively, a positioning-limiting block is installed at the electrical connector for limiting the compression height of the butting electronic element 2. The positioning structure 6 also includes a positioning column 62 for positioning the electronic element. The positioning column 62 prevents the butting electronic element 2 from compressing heavily and damaging the electrical connector. The position-limiting part 61 and the positioning column 62 can be integrated into one piece (alternatively, the position-limiting part 61 and the positioning column 62 can be two separated elements). When the butting electronic element 2 is connected with the electrical connector, the positioning structure 6 fixes the butting electronic electrical 2 and the positioning structure 6 is pressed to contact the swinging body 10 to achieve the electrical connection between two electronic elements.

Figure 6:
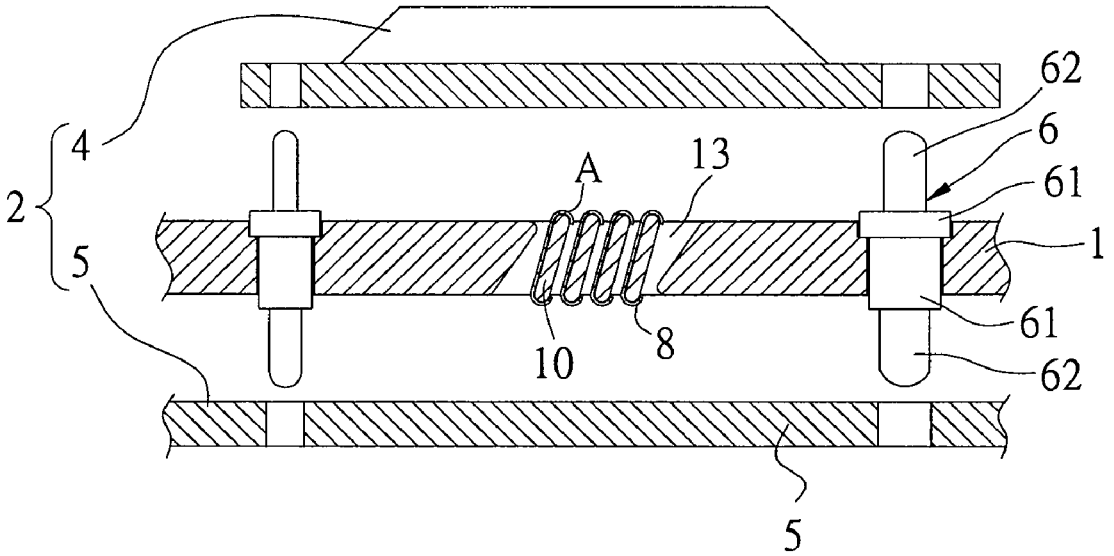
FIG. 6 is a cross-sectional view of another embodiment of the electrical connector of the present invention.

Reference is made to FIG. 6, which shows a cross-sectional view of another embodiment of the electrical connector of the present invention. The difference between this embodiment and the first embodiment is that the conducting material is a metal flake 8. There is a gap between the metal flake 8 and the swinging body 10. This embodiment achieves an effect that is the same as the first embodiment. The structure of the electrical connector is simple and it is easily manufactured. This invention makes the electrical connector contact the electronic element well and reduces the cost of manufacture.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. An electrical connector, comprising:

an insulating body having a receiving space;

a butting electronic element; and a swinging body located in the receiving space and swingingly contacting the butting electronic element, wherein the swinging body comprises a conducting material;

wherein the insulating body and the swinging body are integrated into one piece, and the insulating body and the swinging body are made of flexible material.

2. The electrical connector as claimed in claim 1, wherein the conducting material is a conducting layer.

3. The electrical connector as claimed in claim 2, wherein the conducting layer is formed on the swinging body via a physical film plating method.

4. The electrical connector as claimed in claim 3, wherein the conducting layer is formed on the swinging body via a sputter plating method or an evaporation plating method.

5. The electrical connector as claimed in claim 1, wherein the conducting material is a metal flake.

6. The electrical connector as claimed in claim 1, wherein the insulating body further comprises a connecting part, and the swinging body is connected with the insulating body via the connecting part.

7. The electrical connector as claimed in claim 1, wherein there are contacting points on the two sides of the swinging body, a line linked by these two contacting points is inclined to a surface of the insulating body, thereby, the swinging body is compressed to make the swinging body rotate and swing.

8. The electrical connector as claimed in claim 1, further comprising a position-limiting block for limiting the compression height of the butting electronic element.

9. The electrical connector as claimed in claim 1, further comprising at least two positioning structures that fit in with the butting electronic element.

10. The electrical connector as claimed in claim 1, further comprising a positioning structure located at the insulating body for positioning the butting electronic element and the insulating body.

11. An electrical connector, comprising:

an insulating body having a receiving space;

a butting electronic element; and a positioning structure located at the insulating body for positioning the butting electronic element and the insulating body;

wherein the insulating body further comprises a swinging body located in the receiving space and swingingly contacting with the butting electronic element, and the swinging body comprises conducting material; and, wherein the insulating body and the swinging body are integrated into one piece, and the insulating body and the swinging body are made of flexible material.

12. The electrical connector as claimed in claim 11, wherein the positioning structure comprises a positioning column for positioning the butting electronic element and a position-limiting part for limiting the compression height of the butting electronic element.

13. The electrical connector as claimed in claim 12, wherein the positioning column and the position-limiting part are integrated into one piece.

14. The electrical connector as claimed in claim 12, wherein the positioning column and the position-limiting part are two separated elements.

15. The electrical connector as claimed in claim 11, wherein the conducting material is a conducting layer.

16. The electrical connector as claimed in claim 15, wherein the conducting layer is formed on the swinging body via a physical film plating method.

17. The electrical connector as claimed in claim 16, wherein the conducting layer is formed on the swinging body via a sputter plating method or an evaporation plating method.

18. The electrical connector as claimed in claim 11, wherein the conducting material is a metal flake.

19. The electrical connector as claimed in claim 11, wherein the insulating body further comprises a connecting part, and the swinging body is connected with the insulating body via the connecting part.

20. The electrical connector as claimed in claim 11, wherein there are contacting points on the two sides of the swinging body, a line linked by these two contacting points is inclined to a surface of the insulating body, thereby, the swinging body is compressed to make the swinging body rotate and swing.

* * * * *